United States Patent [19]

Chung

[11] 3,969,074

[45] July 13, 1976

[54] PROCESS FOR DYEING YARN HANKS

[76] Inventor: Hui Do Chung, 361 Kaya-dong, Pusanjin, Pusan, South Korea

[22] Filed: Mar. 25, 1975

[21] Appl. No.: 562,033

[30] Foreign Application Priority Data

May 7, 1974 South Korea ..... 2378

[52] U.S. Cl. ..... 8/155.2; 8/158; 68/27; 68/62

[51] Int. Cl.[2] ..... D06B 5/20

[58] Field of Search ..... 8/155.2, 158; 68/27, 68/62, 188, 206

[56] References Cited

UNITED STATES PATENTS

| | | | |
|---|---|---|---|
| 607,834 | 7/1898 | Corron | 68/206 |
| 1,889,048 | 11/1932 | Haggenmacher | 68/62 |
| 2,053,293 | 9/1936 | Long | 8/155.2 |
| 2,168,479 | 8/1939 | Johnson et al. | 68/62 |

FOREIGN PATENTS OR APPLICATIONS

| | | | |
|---|---|---|---|
| 796,328 | 6/1958 | United Kingdom | 8/155.2 |

*Primary Examiner*—Philip R. Coe

*Attorney, Agent, or Firm*—Wenderoth, Lind & Ponack

[57] ABSTRACT

Two dye baths each have hangers and orificed spindles, about which may be mounted yarn hanks. A dye supply alternatey simultaneously supplies dye through the spindle orifices of one bath to spray dye the yarn hanks therein, and supplies dye into the other bath to dip dye the yarn hanks therein.

2 Claims, 3 Drawing Figures

PROCESS FOR DYEING YARN HANKS

BACKGROUND OF THE INVENTION

This invention relates to a process for dyeing yarn hanks. More particularly, according to this invention, it is possible to dye yarn hanks without causing any loss of the properties possessed by the yarn itself and without effecting the elastic properties of each yarn.

In the prior art it is known to use a dipping system for dyeing yarn hanks, but it is well known that such a system will consume a great amount of dyestuffs, chemicals and vapor because such system requires the use of a high ratio of dye applied to dye used, i.e. a ratio of approximately 1:40 or 50. Accordingly, this prior art system is very expensive to use. Furthermore, such prior art has the defects that the hanging portion of the yarn hanks supported on spindles in the bath may not be dyed or may be formed as an uneven portion because the yarn hanks are suspended from the spindles continuously during the dyeing operation, that there occurs loss of yarn during the unraveling operation of the treated yarn, or that there may appear dye spots on the yarns during the dipping operation so that the coloration of the yarns is not uniform.

On the other hand, there are also known in the prior art spray systems for dyeing yarn hanks. Also, the disadvantages of the above-mentioned dipping system have been somewhat improved by rotating the spindles together with the yarn hanks and by elongating the yarns shrunk during the dyeing operation of the dipping system. Still, however, the operation of unraveling the yarn hanks in such dipping system remains inefficient. Further, even though the spray system requires the use of less dye than the dipping system, it is still difficult to obtain good elongation and formation of the yarns.

SUMMARY OF THE INVENTION

According to the present invention, the above disadvantages are overcome by providing a system combining the advantages of the two known systems.

According to this invention, in order to achieve elongation of the yarns, to provide efficiency in the operation of unraveling the yarn hanks, and to reduce the amount of dye used, the apparatus of this invention comprises two simultaneously operated bath systems, one a dipping system the other a spraying system, the two systems being repeatedly alternated. The yarn hanks in one of the baths are treated by the dipping system, and at the same time, the yarn hanks in the other bath are treated by the spray system. Thus, by repeatedly exchanging such dyeing operations in each bath through the repeated dual operations of the dipping system and the spray system, it is possible to produce dyed yarn without causing any loss of yarn properties and without reducing the elasticity of the yarn.

BRIEF DESCRIPTION OF THE DRAWINGS

Further explanation of this invention appears in detail below taken with the accompanying drawings wherein.

DETAILED DESCRIPTION OF THE INVENTION

The construction of a dyeing apparatus employable in carrying out this invention and the dye-liquid supplying conduits thereof are illustrated in detail in the accompanying drawings, which show that the apparatus includes two dye-liquid baths 1 and 1' alternately repeatedly operated to perform a dipping operation in one bath and a spray operation in the other bath, respectively.

The two dye-liquid baths 1 and 1' are separated from each other by the boundary wall 2, and the height of the boundary wall 2 is lower than the opposite outer side walls of the baths. Thus, when the dye-liquid is supplied to one bath, any excess of the dye-liquid overflowing from such bath during a dipping operation therein will flow into the other bath undergoing a spraying operation therein. Additionally, when a large amount of the dye-liquid overflows from one bath during a dipping operation, the excess of such dye-liquid will be recovered into a separate vessel through the overflow pipe 12.

Figure 1:
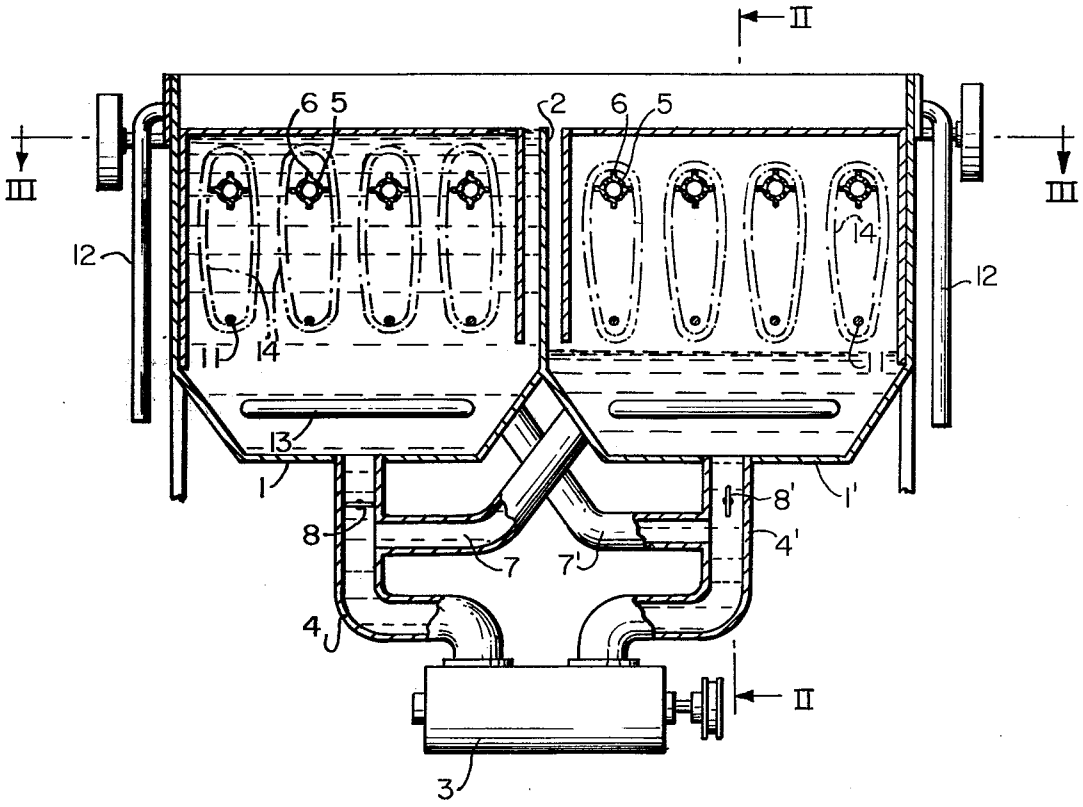
FIG. 1 is the front sectional view of the apparatus of this invention.
Figure 2:
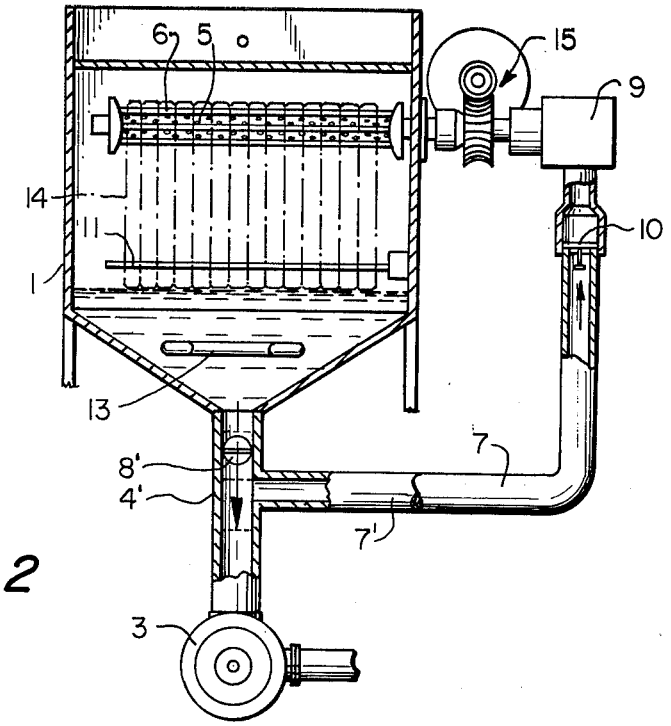
FIG. 2 is a side sectional view along lines II—II in FIG. 1.
Figure 3:
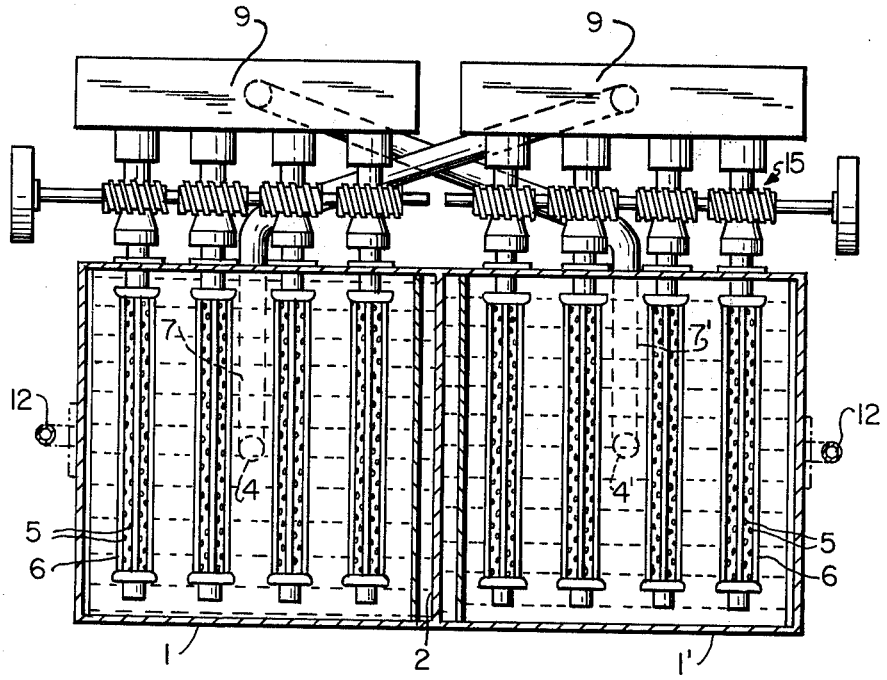
FIG. 3 is a top sectional view along lines III—III in FIG. 1.

Each of the dye-liquid baths 1 and 1' is connected with a dye-liquid supply pump 3 through dye-liquid supply pipes 4 and 4', respectively, in such a manner that dual dyeing operations of dipping and spraying may be performed in both baths. Specifically, each dye-liquid supply conduit from the pump 3 is divided into two pipes. One is the supply pipe 4 or 4' joined to the bottom of the respective bath 1 or 1', and the other is a branch pipe 7 or 7' leading to spray orifices 5 of spindles 6 through distributing means 9, so that the dye-liquid is supplied into the baths 1 and 1' through the supply pipes 4 or 4' or through the branch pipes 7' or 7 that lead to the spindles 6 having the spray orifices 5 through the distributing means 9. In other words, the branch pipe 7 divided from the supply pipe 4 is connected with the spindles 6 in the bath 1' while the branch pipe 7' divided from the supply pipe 4' is connected with the spindles 6 in the bath 1. In the supply pipes 4 and 4' connected with the bottom of the baths 1 and 1', there are provided disc valves 8 and 8', respectively, to control and/or to intercept the supply of the dye-liquid. In the branch pipes 7 and 7', below the respective distributing means 9 which dispense the dye-liquid to the spindles 6, are provided flow-back preventing or non-return valves 10. Within each of the baths 1 and 1', there are provided a plurality of spindles 6, rotating by drive means 15, and hangers 11 so that the yarn hanks 14 are supported by the spindles when the bath is operated for spraying (bath 1' in FIG. 1), or by the hangers when the bath is operated for dipping (bath 1 in FIG. 1). In each bath there is provided a heater 13 to heat the dye-liquid therein, and, as stated above, any dye-liquid overflowing from the baths is collected through the overflow pipes 12 in a separate vessel (not shown).

The device described above is operable to perform the dyeing process of this invention in the following manner.

The yarn hanks 14 are mounted about the spindles 6 and hangers 11 in both of the baths, and are supported by the spindles 6 in the bath which is operated for spraying and by the hangers 11 in the bath operated for dipping. In order to submerge the yarn hanks in the dye-liquid in the particular bath operated for dipping, i.e. bath 1 in FIG. 1, the dye-liquid is supplied to the bath 1 from pump 3 through the supply conduit and the pipe 4 until the yarn hanks in bath 1 are completely submerged in the dye-liquid. Then, in order to intercept further supply of the dye-liquid, the disc valve 8 in the supply pipe 4 is closed. The dye-liquid from the pump 3 is supplied into bath 1', operated for spraying, through the branch pipe 7 divided from the supply pipe 4. The dye-liquid is sprayed through the spray orifices 5 in the spindles 6, connected with the distributing means 9 joined to the branch pipe 7, onto the yarn hanks 14 supported on the spindles in bath 1' and rotated thereby due to the rotation of the spindles. By spraying the dye-liquid through the spray orifices 5, the yarn hanks in the bath 1' are dyed.

In the above example the bath 1 is operated for dipping, and the bath 1' is operated for spraying. It will be understood that this may be reversed such that bath 1' is operated for dipping, while bath 1 is operated for spraying, by supplying dye-liquid through pipe 4', rather than pipe 4.

The temperature of the dye-liquid supplied from the pump is not normally that desired to dye the yarn hanks in the baths. However, by increasing slowly the temperature of the dye-liquid by the heaters 13 in the baths and by alternately circulating the supply of the heated dye-liquid into the baths 1 and 1' repeatedly, good dyeing quality can be accomplished.

After a certain period of time during a dyeing operation, the supply of the dye-liquid to the baths 1 and 1' is exchanged by changing the positions of the valves 8 and 8'. This allows counter-flow of the dye-liquid through the pump 3, and the dyeing operations in each bath can be changed such that the yarn hanks in the baths 1 and 1' can be dyed continuously. After a cooling treatment of the yarn hanks after the dyeing operations, the total process for dyeing the yarns will be finished.

As mentioned above, it is easy to change the dyeing operations of the baths from dipping to spraying, and the yarn hanks in each of the baths are thoroughly dyed by repeated alternate dipping and spraying. Thus, during dipping, the yarn is uniformly subjected to shrink and stretching forces, while during spraying the yarn will attain desired bulkiness. Accordingly, by alternately and simultaneously repeating both dyeing operations, the yarn hanks in each bath can be dyed effectively.

I claim:

1. A process for dyeing yarn hanks, said process comprising:

suspending yarn hanks in each of two separate baths; and repeatedly alternately subjecting said yarn hanks in each of said baths to a dipping dyeing operation and a spraying dyeing operation, said step of subjecting comprising supplying dye into a first of said baths and dip dyeing said yarn hanks therein, while simultaneously spraying dye into a second of said baths and spray dyeing said yarn hanks therein, and then repeatedly alternating said dip dyeing and spray dyeing between said first and second baths.

2. A process as claimed in claim 1, further comprising heating the dye in the one of said baths undergoing said dip dyeing operation.

* * * * *